United States Patent [19]

Krook

[11] Patent Number: 4,759,744

[45] Date of Patent: Jul. 26, 1988

[54] CENTRIFUGAL SEPARATOR WITH RECIRCULATION OF SEPARATED SLUDGE

[75] Inventor: Göran Krook, Stockholm, Sweden

[73] Assignee: Alfa-Laval Separation AB, Tumba, Sweden

[21] Appl. No.: 16,781

[22] Filed: Feb. 20, 1987

[30] Foreign Application Priority Data

Mar. 12, 1986 [SE] Sweden ..... 8601154

[51] Int. Cl.[4] ..... B04B 11/00

[52] U.S. Cl. ..... 494/35; 494/10; 494/38

[58] Field of Search ..... 494/35, 38, 39, 41, 494/42, 2, 5, 7, 10, 22, 23, 27; 210/781, 782

[56] References Cited

U.S. PATENT DOCUMENTS

| | | | |
|---|---|---|---|
| 3,204,686 | 9/1965 | Thomson . | |
| 3,494,545 | 2/1970 | Nilson | 494/38 |
| 3,640,452 | 2/1972 | Thylefors | 494/35 |
| 3,752,389 | 8/1973 | Nilsson | 494/35 |
| 4,278,200 | 7/1981 | Gunnewig . | |
| 4,300,717 | 11/1981 | Latham | 494/41 |
| 4,643,709 | 2/1987 | Lee | 494/35 |

*Primary Examiner*—Robert W. Jenkins

*Attorney, Agent, or Firm*—Davis Hoxie Faithfull & Hapgood

[57] ABSTRACT

In connection with recirculation of separated sludge to the separation chamber of a centrifuge separator there are normally flow restricting nozzles in the sludge outlets of the separation chamber. Only after all separated sludge has passed through these nozzles it is divided into one discharge flow and one recirculation flow.

The invention concerns a centrifugal separator with a recirculation circuit (27, 28, 33, 39, 41, 43, 32, 30, 29) for separated sludge, which is completely free of flow restricting nozzles. The amount of separated sludge, that is allowed to leave the centrifugal separator through the outlet conduit (39) without being recirculated, is determined by setting of valves (22, 40) in the stationary outlet conduits (21, 39) for sludge and clarified liquid, respectively.

6 Claims, 1 Drawing Sheet

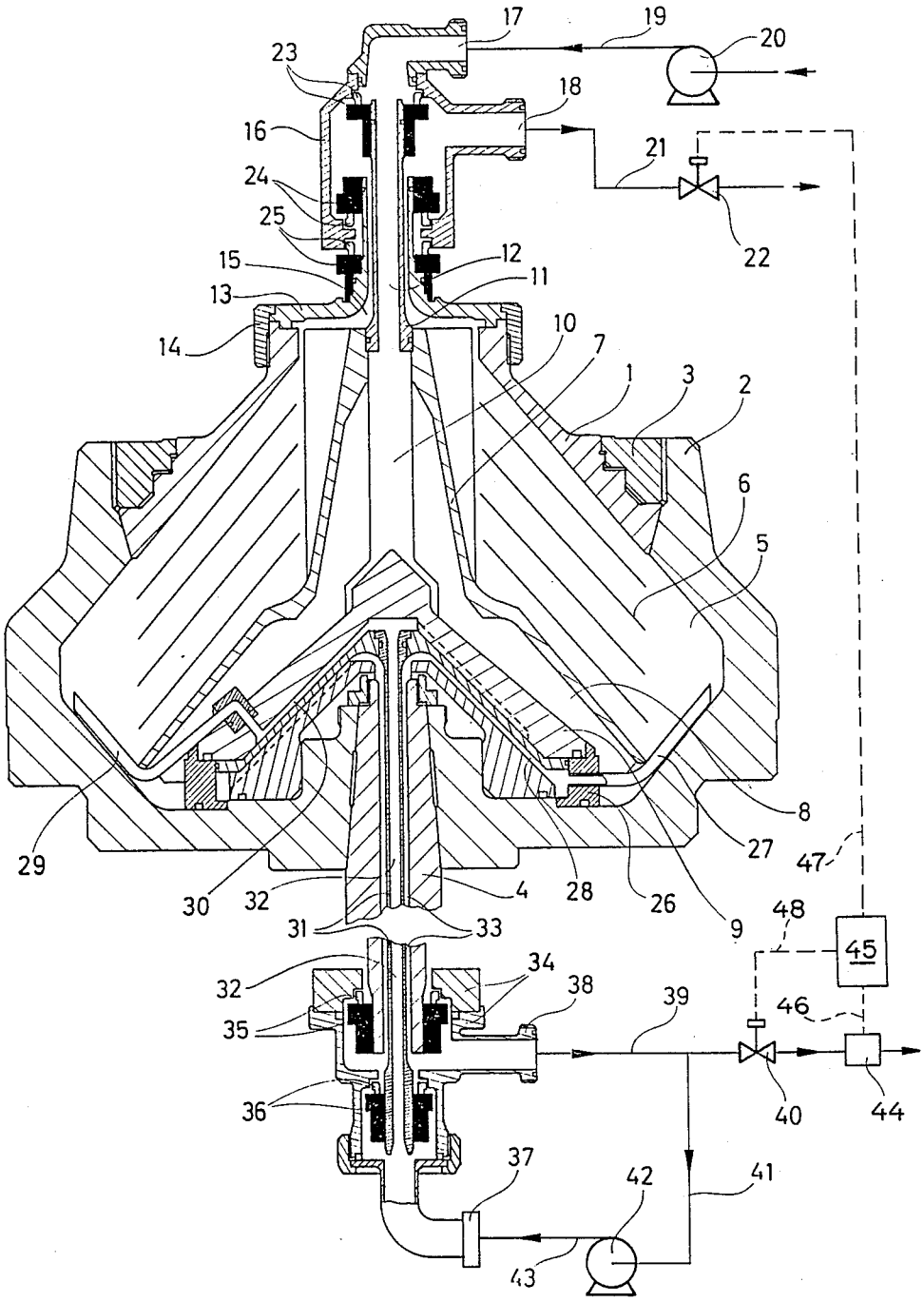
17
19
20
23
18
16
21
24
25
22
15
12
11
13
10
14
7
1
3
2
6
5
8
29
27
47
30
32
4
28
26
9
48
31
33
45
32
34
38
39
46
35
40
44
36
37
42
41
43

CENTRIFUGAL SEPARATOR WITH RECIRCULATION OF SEPARATED SLUDGE

The present invention relates to a centrifugal separator of the kind comprising a rotor with a separation chamber, with a central inlet for a mixture of components to be separated, with a central outlet for separated light component and with a central outlet for separated heavy component; first stationary means forming an inlet channel for a mixture of said components; second stationary means forming an outlet channel for separated light component; third stationary means forming an outlet channel for separated heavy component; a central inlet chamber in the rotor arranged to receive a mixture of components from said stationary first means; first channels in the rotor connecting the central inlet chamber with the separation chamber; second channels in the rotor connecting the radially innermost parts of the separation chamber with the central outlet of the rotor for separated light component; third channels in the rotor connecting the radially outermost parts of the separation chamber with the central outlet of the rotor for separated heavy component; and means for recirculation to the separation chamber of part of such separated heavy component having left the separation chamber through said third channels.

This kind of centrifugal separators are used when the content of heavy component, in the following named sludge, in a mixture is varying heavily or is constantly low, whereas there is constantly a desire for a separated sludge with a certain predetermined concentration.

In a known centrifugal separator of this kind, shown for instance in U.S. Pat. No. 4,278,200, the rotor has sludge outlets in the form of radially extending so called concentrate pipes, in which narrow nozzles are arranged. After its passage through the concentrate pipes the sludge is collected in a central chamber in the rotor from where it is discharged by means of a stationary paring member. Part of the discharged sludge is returned to the rotor, while the rest is carried off. Special sensing means may be used for automatic control of the amount of sludge returned to the rotor.

Determination of the required number of nozzles and the throughflow area of each nozzle in a centrifuge rotor of the known kind above has to be made after consideration of several different factors.

Thus, noticeable factors are among others the particle size and separability of the incoming sludge, the content of sludge in the incoming mixture and the desired concentration of the sludge leaving the centrifuge rotor. It often proves difficult to optimize the centrifuge rotor design such that an exactly desired concentration is obtained of the sludge leaving the rotor. For instance, it is normally a desideratum that a very high concentration should be obtained of the sludge, which desideratum often cannot be fulfilled, however, due to the risk of clogging of the outlet nozzles.

Part of the difficulty in optimizing the centrifuge rotor design resides in the fact that the necessary flow restricting property of the nozzles limits the freedom of choice as to the desired degree of sludge recirculation. Depending upon the separability of the sludge, a certain smallest flow velocity thus has to be maintained in the so called concentrate pipes extending from the radially outermost parts of the separation chamber to the central chamber.

For the above mentioned reasons it is obvious that a centrifuge rotor of the known kind has to be provided with special nozzles for each new application and, further, that there is left very small margins as to the control of the sludge recirculation when there is a desire for a high concentration of the sludge.

A particular problem in connection with centrifuge rotors of the known kind, especially at a low content of sludge in the mixture supplied to the rotor, is that the same sludge particles have to be subjected to repeated recirculation and thus pass through the nozzles several times. The repeated pressure changes for which the sludge is subjected during these passages may have a destroying effect on certain sensitive sludge particles.

The object of the present invention is to provide an improved centrifugal separator of the initially defined kind, in which part of the separated sludge is recirculated. The improvement is to be such that narrow nozzles in the recirculation circuits may be avoided and that the flow velocity of the recirculation flow may be chosen independent of a chosen setting for the desired concentration of the sludge leaving the rotor.

This object may be obtained according to the invention in a way such that sealing means is arranged for such a connection of said first, second and third stationary means to the respective central inlets and outlets of the rotor, that during operation the supplied mixture and the discharged separated components are kept separate from contact with each other and with the atmosphere surrounding the rotor; that a pump means is arranged to supply said mixture of components to the separation chamber in a way such that a hydraulically rigid connection is maintained during the operation of the rotor from said central inlet through the separation chamber to the respective central outlets; that means operable during the operation of the rotor is arranged for setting of a desired relation between the flows of separated light and heavy components, respectively, through said outlet channels; and that said recirculation means is formed for a closed returning of said part of the separated heavy component, i.e. sludge, so that this is kept separate from contact with the atmosphere surrounding the rotor.

By the invention a desired concentration of the sludge leaving the rotor may readily be set, and changed if desired, only by adjustment of the relations between the flows of sludge and liquid that is freed from sludge, respectively, discharged through the said outlet channels. Furthermore, according to the invention the recirculation of sludge may be set as desired according to need and may be allowed to increase or decrease during the operation of the rotor without this having to influence the set concentration of the sludge that is carried off. Throttles in the recirculation circuit are not needed and should not be present.

Within the scope of the invention the recirculated sludge may be returned to the separation chamber through different ways, for instance together with the mixture of components supplied by said pump means.

A preferred embodiment of the invention is characterized in that a further pump means is connected to either one of the recirculation channel and the outlet channel for returning part of the sludge flowing through the outlet channel. Hereby, the recirculated sludge may be supplied downstream of a stationary pump means connected to the rotor inlet.

Preferably said recirculation means comprises a stationary part forming a recirculation channel, which starts from said outlet channel for separated heavy component, and a part rotatable with the rotor and forming recirculation channels in the rotor, which are separated from the central inlet chamber and the channels starting therefrom. Hereby is avoided that the recirculated sludge is distributed in the supplied new mixture and, thus, has to be separated therefrom again. According to the invention, therefore, sealing means is arranged for such a connection of the stationary part to the rotatable part of the recirculation means that recirculated sludge is kept separate from contact with the atmosphere surrounding the rotor as well as the supplied mixture and separated light component.

The said sludge recirculation channels in the rotor preferably open at the radially outermost parts of the separation chamber in areas situated between the above mentioned third channels through which sludge is flowing towards the rotor centre. Hereby it is possible during the operation of the rotor to maintain a constant flow of sludge along the said outermost parts of :he separation chamber, so that sludge cushions can not be formed in these parts. Further, cleaning of the separation chamber after finished operation is hereby facilitated, since cleaning liquid may be forced through the said channels via the radially outermost parts of the separation chamber.

The invention will be further described with reference to the accompanying drawing which shows a preferred embodiment thereof.

In the drawing there is shown a rotor comprising two parts 1 and 2, which are axially held together by means of a locking ring 3. The rotor is supported by a vertical drive shaft 4.

Within the rotor there is formed a separation chamber 5, in which there is arranged a stack of conical separation discs 6. The separation discs rest on the lower part of a distributor 7, which on its underside has radial distribution wings 8. The distributor 7 rests through the wings 8 on a conical partition 9 situated centrally in the rotor.

Within the distributor 7 there is formed a central inlet chamber 10 which through the passages between the wings 8 communicates with the separation chamber 5 at the area of the radially outer edge of the lowermost separation disc.

The distributor 7 supports a central pipe 11 extending axially out of the rotor and forming an inlet channel 12 in communication with the inlet chamber 10. The pipe 11 is surrounded by a further partly tubular member 13, which is supported by the rotor part 1 and is connected therewith by means of a locking ring 14. Between the pipe 11 and the member 13 there is formed an annular channel 15 which directly communicates with the central parts of the separation chamber 5 and constitutes an outlet channel therefrom.

Around the pipe 11 as well as the member 13 there is arranged a stationary member 16. This is provided with an inlet 17 for a liquid mixture to be supplied to the rotor and an outlet 18 for liquid having been separated in the rotor. The inlet 17 communicates with the inlet channel 12, whereas the outlet 18 communicates with the annular outlet channel 15. To the inlet 17 there is connected an inlet conduit 19, in which there is a pump 20, and to the outlet 18 there is connected an outlet conduit 21 in which there is an adjustable valve 22.

Between the stationary member 16 and the inlet tube 11 there is arranged a first mechanical seal 23, and between the stationary member 16 and the partly tubular member 13 there is arranged a second mechanical seal 24, 25. The first mechanical seal 23 is of a single kind with one stationary sealing ring and one rotatable sealing ring, which sealing rings abut axially against each other. The second mechanical seal 24, 25 is of a so called double kind with two pairs of such sealing rings. In a manner known per se the double mechanical seal should be charged with so called sealing liquid in the space between the two pairs of sealing rings. For simplifying of the drawing there is not shown any such arrangement for supply of sealing liquid, however.

Between the conical partition 9 and the lower rotor part 2 there is arranged a short cylindrical sleeve 26. This supports several pipes 27 which are evenly distributed around the rotor axis and extend radially from the sleeve 26 to the radially outermost parts of the separation chamber 5. Through bores in the sleeve 26 the interior of the pipes 27 communicates with the channels 28 which extend radially towards the rotor centre.

Further pipes 29 extend radially inward from the radially outermost parts of the separation chamber. These pipes 29 are supported by the conical partition 9. Through bores in the partition 9 the interior of the pipe 29 communicates with channels 30 which extend radially towards the rotor centre.

The vertical drive shaft 4 has a central bore in which there is inserted a pipe 31. This pipe forms a central channel 32 and has on its outside several axial grooves forming axial channels 33 between the pipe 31 and the surrounding drive shaft 4.

At the rotor centre the upper end of the central channel 32 in the pipe 31 communicates with the radial channels 30, and the axial channels 33 communicate with the radial channels 28.

For simplifying of the drawing there is shown no arrangement for driving and journalling of the drive shaft 4. At its lowermost end the drive shaft is surrounded by a stationary member 34. Between this and the drive shaft 4 and the pipe 31 arranged therein, respectively, there are arranged two mechanical seals 35 and 36. One mechanical seal 35 comprises one stationary sealing ring, which is supported by the member 34, and one rotatable sealing ring supported by the drive shaft 4. The other mechanical seal 36 comprises one stationary sealing ring, which is supported by the member 34, and one rotatable sealing ring supported by the pipe 31. If desired, the seal 35 may be made double like the seal 24, 25.

The stationary member 34 has one inlet 37 communicating with the channel 32 in the pipe 31, and one outlet 38 communicating with the channels 33 between the pipe 31 and the drive shaft 4. The outlet 38 is connected to an outlet conduit 39, in which there is arranged an adjustable valve 40. From the outlet conduit 39 there is brached off a branch conduit 41—between the outlet 38 and the valve 40—which is connected to the inlet of a pump 42. The outlet of the pump 42 through a conduit 43 is connected to the inlet 37 of the member 34.

The above described arrangement is intended to operate in the following manner.

A liquid mixture comprising sludge is supplied to the rotor by means of the pump 20. The mixture enters through the channel 12 into the central receiving chamber 10 of the rotor and flows further between the distribution wings 8 to the separation chamber 5.

In the separation chamber 5 the sludge is separated from the mixture and is collected in the radially outermost parts thereof. Clarified liquid flows radially inward and leaves the separation chamber through the channel 15, the outlet 18 and the conduit 21.

The separated sludge and a small amount of remaining liquid 1s pressed by the overpressure of the pump 20 radially inward through the pipes 27 and further through the channels 28 and 33 to the outlet 38. Through the outlet conduit 39 part of the sludge leaves through the valve 40, while the rest of the sludge by means of the pump 42 is returned to the separation chamber 5 through the conduits 41 and 43, the channels 32 and 30 and the pipes 29.

Depending upon the content of sludge in the supplied mixture and the desired concentration of the separated sludge which should leave through the outlet conduit 39, the valves 22 and 40 are set in a way such that a certain desired relation is obtained between the flows through these valves. The valves 22 and 40 thus form throttles in the conduits 21 and 39, respectively, and are connected in a hydraulically rigid manner with each other and with the inlet pump 20 through the separation chamber 5.

The pump 42 which may have a controllable speed is adjusted with respect to its capacity such that a desired degree of sludge recirculation is obtained. Determining for this is above all a certain required flow velocity in the pipes 27. This velocity has to be sufficiently large so that the sludge particles which should move radially inward in the pipes 27 are not prevented by the centrifugal force from performing such a movement and instead be separated out of the small amount of carrying liquid in which they are suspended.

If the content of sludge in the supplied mixture is expected to vary during operation, there are preferably means for automatic change of the setting of at least one of the valves 22 and 40. Such means may comprise sensing members of different kinds which are arranged for controlling of the setting of at least one of the valves 22, 40. The sensing members thus may be present in one of the conduits 19, 21 and 39. In the inlet conduit 19 a change of the sludge content of the supplied mixture may be directly sensed. In the outlet conduit 21 it can be sensed if the content of remaining sludge in the clarified liquid increases or decreases. In the outlet conduit 39 it can be sensed if the concentration of the separated sludge increases or decreases. In all of the cases a sensed change would cause an adjustment of the setting of one or both of the valves 22 and 40. In this way the concentration of the separated sludge may be maintained substantially constant and the amount of sludge having accumulated in the centrifuge rotor may be maintained substantially unchanged.

As an example of means for setting valves 22 and 40, sensing means 44 of any conventional type is positioned in the outlet conduit 39. A control unit 45 is positioned to control valves 22 and 40 via lines 47 and 48 in response to a signal from means 44, transmitted via line 46.

I claim:

1. Centrifugal separator comprising a rotor with a separation chamber (5), a central inlet (12) for a mixture of components to be separated, a central outlet (15) for separated light component and a central outlet (33) for separated heavy component, first stationary means forming an inlet channel (19) for a mixture of said components, second stationary means forming an outlet channel (21) for separated light component, third stationary means forming an outlet channel (39) for separated heavy component, a cetral inlet chamber (10) in the rotor arranged to receive a mixture of components from said stationary first means, first channels in the rotor connecting the central inlet chamber (10) with the separation chamber (5), second channels in the rotor connecting the radially innermost parts of the separation chamber (5) with the central outlet (15) of the rotor for separated light component, third channels (27, 28) in the rotor connecting the radially outermost parts of the separation chamber (5) with the central outlet (33) of the rotor for separated heavy component, and means (41–43) for recirculation to the separation chamber part of such separated heavy component having left the separation chamber through said third channels, characterized in that sealing means (23–25, 35) are arranged for such a connection of said first, second and third stationary means to the respective central inlet (12) and outlets (15, 33) of the rotor, that during operation the supplied mixture and discharged separated components are kept separate from contact with each other and with the atmosphere surrounding the rotor, that a pump means (20) is arranged to supply said mixture of components to the separation chamber (5) in a manner such that a hydraulically rigid connection is maintained during the operation of the rotor from said central inlet (12) through the separation chamber (5) to the respective central outlets (15, 33), that means (22, 40) operable during the operation of the rotor is arranged for setting of a desired relation between the flows of separated light and heavy components, respectively, through said outlet channels (21, 39), and that said recirculation means (41–43) are formed for closed returning of said part of the separated heavy component such that this is kept separate from contact with the atmosphere surrounding the rotor.

2. Centrifugal separator according to claim 1, characterized in that said recirculation means has a stationary part forming a recirculation channel (41, 43), which starts from said outlet channel (39) for separated heavy component, and that a further pump means (42) is connected to either one of the recirculation channel (41, 43) and the outlet channel (39) for returning part of the separated heavy component flowing through the outlet channel (39).

3. Centrifugal separator according to claim 1, in which said recirculation means comprises a part rotatable with the rotor and forming recirculation channels (29, 30, 32) in the rotor, which are separated from the central inlet chamber (10) and the channels starting therefrom, characterized in that the recirculation channels in the rotor open at the radially outermost parts of the separation chamber (5) in areas situated between said third channels (27, 28) seen in the peripheral direction of the rotor.

4. Centrifugal separator according to claim 1, in which said recirculation means has one stationary part forming a recirculation channel (41, 43), which starts from said outlet channel (39) for separated heavy component, and one part rotatable with the rotor and forming recirculation channels (29, 30, 32) in the rotor, which are separated from the central inlet chamber (10) and from the channels starting therefrom, characterized in that sealing means (36) is arranged for such a connection of the stationary part to the rotatable part of the recirculation means, that returned separated heavy component is kept separated from contact with atmosphere surrounding the rotor as well as mixture supplied and separated light component.

5. Centrifugal separator according to claim 1, in which sensing means is arranged to sense the concentration of a certain substance in either one of the supplied mixture and one of the separated components, characterized in that said operable means (22; 40) is connected with the sensing means and arranged automatically, depending upon the sensed concentration, to adjust the relation between the flows throagh the outlet channels (21, 39) for separated light and heavy component, respectively, such that a substantially unchanged concentration is obtained of the separated heavy component leaving the rotor.

6. Centrifugal separator according to claim 1, characterized in that said means (41–43) for returning part of the separated heavy component to the separation chamber is arranged for setting of a desired flow of heavy component thus returned, independent of the setting of said operable means (22, 40).

* * * * *